US006203407B1

(12) United States Patent
Robinson

(10) Patent No.: US 6,203,407 B1
(45) Date of Patent: Mar. 20, 2001

(54) METHOD AND APPARATUS FOR INCREASING-CHEMICAL-POLISHING SELECTIVITY

(75) Inventor: Karl M. Robinson, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/146,733

(22) Filed: Sep. 3, 1998

(51) Int. Cl.[7] ..... B24B 1/00
(52) U.S. Cl. ..... 451/41; 451/527
(58) Field of Search ..... 451/41, 527, 530, 451/537, 913; 156/645.1, 653; 51/209, 283, 293

(56) References Cited

U.S. PATENT DOCUMENTS

| | | | | |
|---|---|---|---|---|
| Re. 31,053 | | 10/1982 | Firtion et al. | 355/77 |
| Re. 34,425 | | 11/1993 | Schultz | 51/165 |
| 816,461 | | 4/1906 | Gorton . | |
| 888,129 | | 5/1908 | Tone . | |
| 959,054 | | 5/1910 | Glover | 143/140 |
| 1,953,983 | | 4/1934 | Benner | 451/527 |
| 2,242,877 | | 5/1941 | Albertson . | |
| 2,409,953 | | 10/1946 | Pash | 51/133 |
| 2,653,428 | | 9/1953 | Fuller . | |
| 2,749,681 | | 6/1956 | Reidenbach . | |
| 2,749,683 | | 6/1956 | Soderman . | |
| 3,468,079 | | 9/1969 | Kaufman | 51/378 |
| 3,495,362 | | 2/1970 | Hillenbrand | 51/395 |
| 3,517,466 | | 6/1970 | Bouvier | 51/358 |
| 3,627,338 | * | 12/1971 | Thompson | 451/388 X |
| 4,183,545 | * | 1/1980 | Daly | 451/388 X |
| 4,244,775 | | 1/1981 | D'Asaro | 156/636 |
| 4,271,640 | | 6/1981 | Gadbois et al. | 51/400 |
| 4,373,991 | | 2/1983 | Banks | 156/645 |
| 4,603,867 | * | 8/1986 | Babb et al. | 451/388 X |
| 4,621,458 | | 11/1986 | Smith | 51/111 |
| 4,663,890 | | 5/1987 | Brandt | 51/283 |
| 4,666,553 | | 5/1987 | Blumenfeld et al. | 156/643 |

(List continued on next page.)

FOREIGN PATENT DOCUMENTS

| | | |
|---|---|---|
| 679731 | 2/1964 | (CA) . |
| 0318135 | 5/1988 | (EP) . |
| 0439124 | 1/1991 | (EP) . |
| 1-195.595 | 11/1959 | (FR) . |
| 69.34956 | 10/1969 | (FR) . |
| 26287 | 1/1906 | (GB) . |
| 2043501 | 2/1979 | (GB) . |
| 62.99072 | 8/1987 | (JP) . |
| 1206067 | 2/1984 | (RU) . |

OTHER PUBLICATIONS

Brent Beachen "Chemical Mechanical Polishing: The Future of Sub Half Micron Devices" for EcEn 553–Brigham Young University/Dr. Linton, Nov. 15, 1996.

*Primary Examiner*—Joseph J. Hail, III
*Assistant Examiner*—Anthony Ojini
(74) *Attorney, Agent, or Firm*—Schwegman, Lundberg, Woessner & Kluth, P.A.

(57) ABSTRACT

Method and apparatus for increasing chemical-mechanical-polishing (CMP) selectivity is described. A CMP pad is formed having a pattern of recesses and islands to provide non-contact portions and contact portions, respectively, with respect to contacting a substrate assembly surface to be polished. As the CMP pad is formed from a non-porous material, chemical and mechanical components of material removal are parsed to the non-contact portions and the contact portions, respectively. The relationship or spacing from one contact island to another, or, alternatively viewed, from one non-contact recess to another, provides a duty cycle, which is tailored to increase selectivity for removal of one or more materials over removal of one or more other materials during CMP of a substrate assembly.

20 Claims, 6 Drawing Sheets

U.S. PATENT DOCUMENTS

| | | | | |
|---|---|---|---|---|
| 4,671,851 | | 6/1987 | Beyer et al. | 156/645 |
| 4,679,359 | | 7/1987 | Suzuki | 51/321 |
| 4,693,036 | | 9/1987 | Mori | 51/131.3 |
| 4,711,610 | * | 12/1987 | Riehl | 451/388 X |
| 4,715,150 | | 12/1987 | Takeuchi et al. | 51/395 |
| 4,739,589 | | 4/1988 | Brehm et al. | 51/281 |
| 4,773,185 | | 9/1988 | Taira | 51/118 |
| 4,789,424 | | 12/1988 | Fornadel et al. | 156/637 |
| 4,811,522 | | 3/1989 | Gill, Jr. | 51/131.1 |
| 4,821,461 | | 4/1989 | Holmstrand | 51/209 |
| 4,843,766 | | 7/1989 | Umeda . | |
| 4,918,872 | | 4/1990 | Sato et al. | 51/209 |
| 5,020,283 | | 6/1991 | Tuttle | 51/209 |
| 5,036,015 | | 7/1991 | Sandhu et al. | 437/8 |
| 5,069,002 | | 12/1991 | Sandhu et al. | 51/165 |
| 5,081,796 | | 1/1992 | Schultz | 51/165 |
| 5,131,190 | | 7/1992 | Gougouyan | 51/129 |
| 5,137,597 | | 8/1992 | Curry, II et al. | 156/636 |
| 5,142,828 | | 9/1992 | Curry, II | 51/281 |
| 5,169,491 | | 12/1992 | Doan | 156/636 |
| 5,177,908 | | 1/1993 | Tuttle | 51/283 |
| 5,196,353 | | 3/1993 | Sandhu et al. | 437/8 |
| 5,209,816 | | 5/1993 | Yu et al. | 156/636 |
| 5,216,843 | | 6/1993 | Breivogel et al. | 51/131.1 |
| 5,222,329 | | 6/1993 | Yu | 51/165.77 |
| 5,223,734 | | 6/1993 | Lowrey et al. | 257/401 |
| 5,225,034 | | 7/1993 | Yu et al. | 156/636 |
| 5,232,875 | | 8/1993 | Tuttle et al. | 437/225 |
| 5,234,867 | | 8/1993 | Schultz et al. | 437/225 |
| 5,240,552 | | 8/1993 | Yu et al. | 156/636 |
| 5,244,534 | | 9/1993 | Yu et al. | 156/636 |
| 5,297,364 | | 3/1994 | Tuttle | 51/209 R |
| 5,300,155 | | 4/1994 | Sandhu et al. | 148/33 |
| 5,302,233 | | 4/1994 | Kim et al. | 156/636 |
| 5,314,843 | | 5/1994 | Yu et al. | 437/225 |
| 5,318,927 | | 6/1994 | Sandhu et al. | 437/225 |
| 5,329,734 | | 7/1994 | Yu | 51/283 |
| 5,354,490 | | 10/1994 | Yu et al. | 252/79.1 |
| 5,380,546 | | 1/1995 | Krishnan et al. | 427/126.1 |
| 5,382,551 | | 1/1995 | Thakur et al. | 437/247 |
| 5,394,655 | | 3/1995 | Allen et al. | 451/63 |
| 5,395,801 | | 3/1995 | Doan et al. | 437/225 |
| 5,413,941 | | 5/1995 | Koos et al. | 437/8 |
| 5,421,769 | | 6/1995 | Schultz et al. | 451/287 |
| 5,439,551 | | 8/1995 | Meikle et al. | 156/626.1 |
| 5,441,598 | | 8/1995 | Yu et al. | 156/645.1 |
| 5,449,314 | | 9/1995 | Meikle et al. | 451/41 |
| 5,486,129 | | 1/1996 | Sandhu et al. | 451/5 |
| 5,487,697 | | 1/1996 | Jensen | 451/324 |
| 5,489,233 | | 2/1996 | Cook et al. | 451/41 |
| 5,514,245 | | 5/1996 | Doan et al. | 156/636.1 |
| 5,533,924 | | 7/1996 | Stroupe et al. | 451/286 |
| 5,540,810 | | 7/1996 | Sandhu et al. | 156/636.1 |
| 5,558,563 | | 9/1996 | Cote et al. | 451/41 |
| 5,578,362 | | 11/1996 | Reinhardt et al. | 428/147 |
| 5,605,760 | | 2/1997 | Roberts | 428/409 |
| 5,609,718 | | 3/1997 | Meikle | 156/626 |
| 5,650,039 | | 7/1997 | Talieh | 156/636 |
| 5,690,540 | | 11/1997 | Elliott et al. | 451/41 |
| 5,730,642 | * | 3/1998 | Sandhu et al. | 451/286 X |

* cited by examiner

METHOD AND APPARATUS FOR INCREASING-CHEMICAL-POLISHING SELECTIVITY

FIELD OF THE INVENTION

The present invention relates generally to semiconductor manufacture, and more particularly to polishing a substrate assembly surface using a chemical-mechanical-polishing (CMP) pad.

BACKGROUND OF THE INVENTION

In microchip fabrication, integrated circuits are formed on a substrate assembly. By substrate assembly, it is meant to include a bare wafer, as well as a wafer having one or more layers of material formed on it. Such layers are patterned to produce devices (e.g., transistors, diodes, capacitors, interconnects, etc.) for integrated circuits. In forming these devices, the one or more patterned layers can result in topographies of various heights.

In patterning layers on a wafer or patterning trenches in a wafer, lithography is used to transfer an image on a mask to a surface of the substrate assembly. Lithography ("microlithography" or "photolithography") has resolution limits based in part on depth of focus requirements. These limits become more critical as geometries are diminished. Thus, to have a target surface area of a substrate assembly in focus for lithographic patterning, it is necessary that the target surface area be sufficiently planar for the lithography employed. However, topographies of various heights make planarity problematic.

One approach to obtaining sufficient planarity is using a chemical-mechanical-polishing (CMP) process. CMP may be used to remove unwanted material, and more particularly, may be employed to planarize a surface area of a substrate assembly. In removing unwanted material, it is important to remove as little wanted material as possible. Thus, chemical solutions used in CMP are often formulated to be more selective to remove one material over another, and thus the solution's chemical composition is directed at removing different materials at different rates. One such solution, Rodel ILD1300 made by Rodel, Inc. of Newark, Del., has a four to one (4:1) selectivity of boro-phospho-silicate glass (BPSG) to a doped silicon oxide formed from tetraethyl orthosilicate (TEOS) [hereinafter the doped silicon oxide formed from TEOS is referred to as "TEOS"]. Rodel ILD1300 also has a twelve to one (12:1) selectivity of BPSG to nitride. Conventionally, improvements in CMP selectivity between silicon nitride and BPSG/TEOS, polysilicon and BPSG/TEOS, or tungsten and titanium nitride have been made by changing chemical composition of the solution, such as by varying pH for selectivity to nitride or varying oxidants for selectivity to metal.

In addition to chemical reactions, CMP also includes a mechanical component for removing material. Mechanical removal for CMP is generally described by Preston's equation:

$$R_{CMP}=K_{CMP}vP \tag{1}$$

where $R_{CMP}$ is the mechanical removal rate, P is the pressure, v is the relative velocity between a porous polishing pad and a substrate assembly surface, and $K_{CMP}$ is a constant proportional to the coefficient of friction between the pad and the substrate assembly surface. Conventionally, P is 20,685 to 55,160 Pa (3 to 8 pounds per square inch (psi)) and n is 0.333 to 1.667 rev/s (20 to 100 rpms). $K_{CMP}$ depends on the material(s) being removed.

As direct contact between the pad and the substrate assembly surface reduces removal rate owing to an absence of CMP solution, porous pads with continuous grooves in concentric ellipses have been made. By porous, it is meant that CMP solution particles may be absorbed within pad material. Such intrinsically porous pads allow for transport of CMP solution particles across raised portions of pads with continuous grooves. Pitch of such grooves or channels is conventionally 0.1 to 2 mm wide. Notably, this approach is directed at removing materials more readily, and not directed at selectively removing a material as between materials.

A non-porous pad is described in U.S. Pat. No. 5,489,233 to Cook, et al. In Cook et al., a pad is formed out of a solid uniform polymer sheet. The polymer sheet has no intrinsic ability to absorb CMP solution particles. Such non-porous pads are formed with channels of varying configurations (macro-textured). The raised portions or contact portions of such non-porous pads are roughened (micro-textured) to allow transport of slurry particulate from channel to channel. Notably, such pads may be impregnated with microelements to provide such micro-texturing, as described in U.S. Pat. No. 5,578,362 to Reinhardt, et al.

In Cook et al., it is suggested that polishing rates may be adjusted by changing the pattern and density of the applied micro-texture and macro-texture. However, Cook et al. does not show or describe tailoring selectivity to particular materials. Accordingly, it would be desirable to have a methodology for CMP pad manufacturing which allows a target selectivity to be programmed into a CMP pad for a desired application.

SUMMARY OF THE INVENTION

The present invention provides enhanced selectivity in a CMP process by providing a special purpose CMP pad. Such a CMP pad includes at least one predetermined duty cycle of non-contact portions (those surfaces directed toward but not contacting a substrate assembly surface during polishing) to contact portions (those surfaces directed toward and contacting a substrate assembly surface during polishing). Such a CMP pad is formed at least in part from a material that intrinsically is non-porous with respect to a CMP solution particulate to be employed with use of the pad. Furthermore, such a CMP pad may be configured to transport CMP solution particulate across its contact portions. Such a CMP pad alters relative removal rates of materials without altering CMP solution chemical composition.

A duty cycle in accordance with the present invention is provided by configuring a CMP pad with a recessed portion or a raised portion, such as by a recess or an island, to provide a non-contact portion and a contact portion, respectively. A duty cycle or spatial frequency for an arrangement or pattern of islands or recesses is selected to enhance selectivity as between materials to be polished. Accordingly, such a CMP pad may be programmed with a target selectivity by configuring it with a predetermined duty cycle.

CMP pads in accordance with the present invention are to provide improved selectivity over CMP chemical selectivities alone. Such pads may be used to remove one dielectric in the presence of another dielectric, such as one silicon oxide, doped or undoped, in the presence of another silicon oxide, doped or undoped.

BRIEF DESCRIPTION OF THE DRAWING(S)

Features and advantages of the present invention will become more apparent from the following description of the preferred embodiment(s) described below in detail with reference to the accompanying drawings where:

Figure 1:
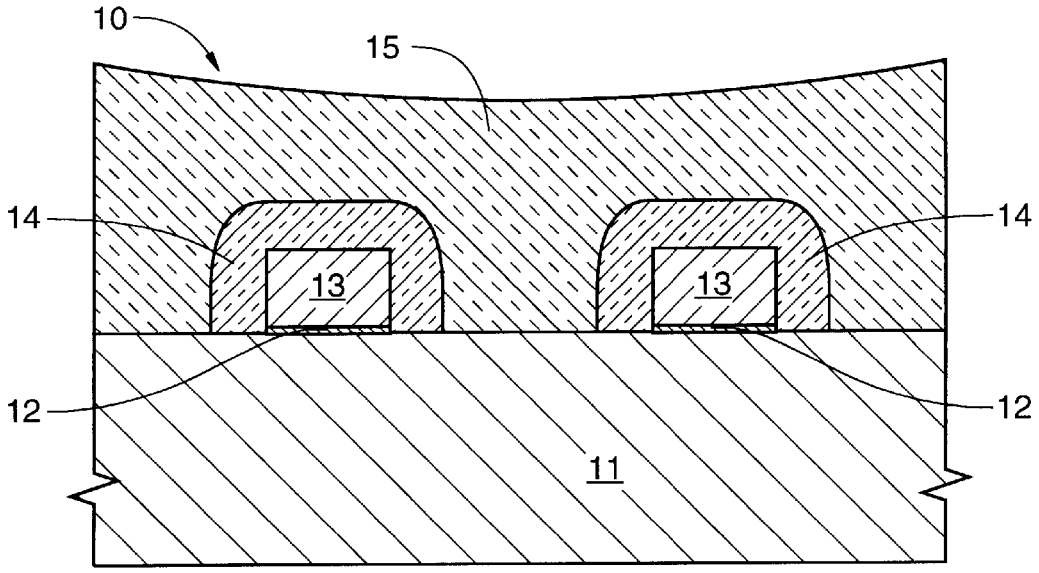
FIG. 1 is a cross-sectional view of an exemplary portion of a substrate assembly prior to planarization.

Reference numbers refer to the same or equivalent parts of the present invention throughout the several figures of the drawing.

DESCRIPTION OF THE PREFERRED EMBODIMENT(S)

Though a stop on TEOS CMP planarization process for removal of BPSG embodiment is described in detail herein, it will be apparent to one of ordinary skill in the art that the present invention may be practiced with other materials, some of which are described elsewhere herein.

Referring to FIG. 1, there is shown a cross-sectional view of an exemplary portion of a substrate assembly 10 prior to planarization. Substrate assembly 10 comprises substrate 11 (e.g., a semiconductive material such as single crystalline silicon), transistor gate oxide 12, transistor gate 13, TEOS layer 14, and BPSG layer 15. TEOS layer 14 acts as an insulator for transistor gate 13. As such, it is important not to remove too much TEOS from layer 14 when planarizing.

Figure 2:
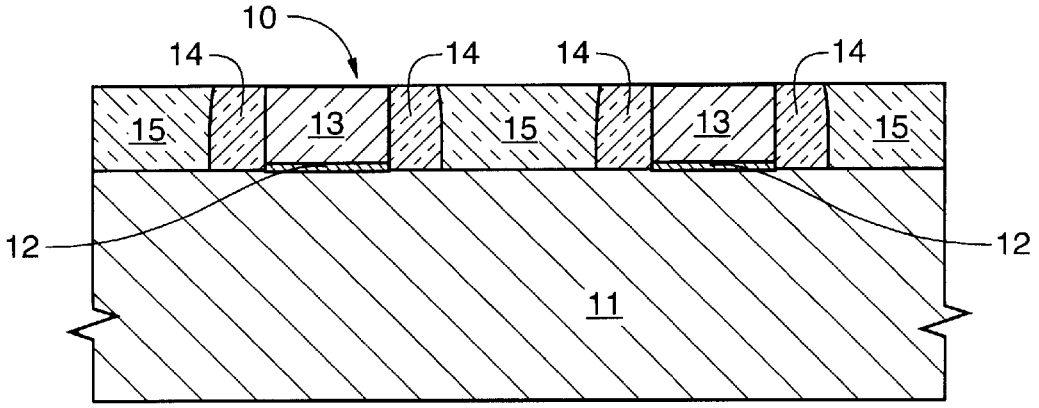
FIG. 2 is a cross-sectional view of the substrate assembly of FIG. 1 after conventional planarization.

Referring to FIG. 2, there is shown a cross-sectional view of substrate assembly 10 of FIG. 1 after conventional planarization. In this example, TEOS layer 14 has been completely remove above transistor gate 13. This is to emphasize that owing to conventional selectivity limits, there is a relatively narrow process window in which to stop a CMP process from removing too much TEOS from layer 14 when planarizing BPSG layer 15.

Figure 3:
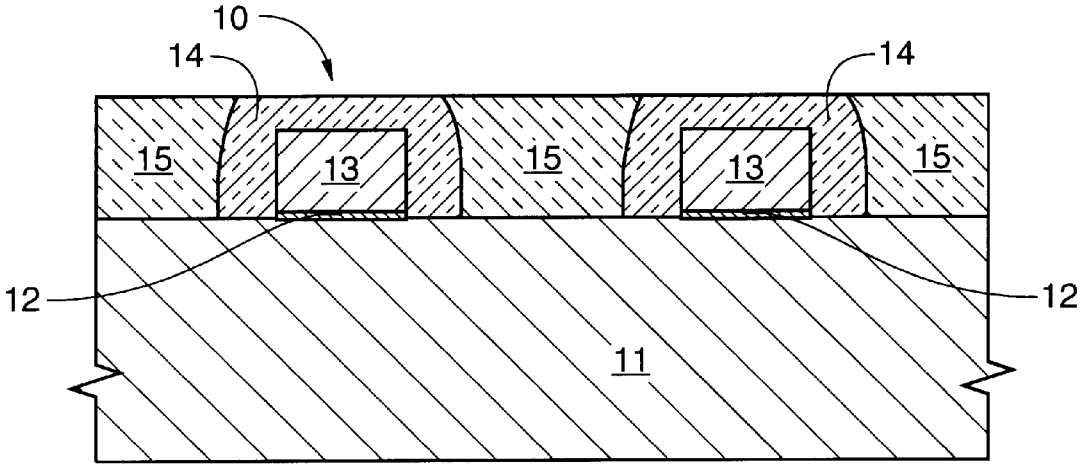
FIG. 3 is a cross-sectional view of the substrate assembly of FIG. 1 after planarization in accordance with the present invention.

In FIG. 3, there is shown a cross-sectional view of substrate assembly 10 after planarization in accordance with the present invention. A comparison of substrate assembly 10 of FIGS. 2 and 3 demonstrates an increase in process window with the present invention. In this embodiment, because of an increase in selectivity to BPSG over TEOS provided by the present invention, a CMP process window is increased such that there is more time in which to expose substrate assembly 10 to polishing without significantly removing TEOS from layer 14.

Figure 4:
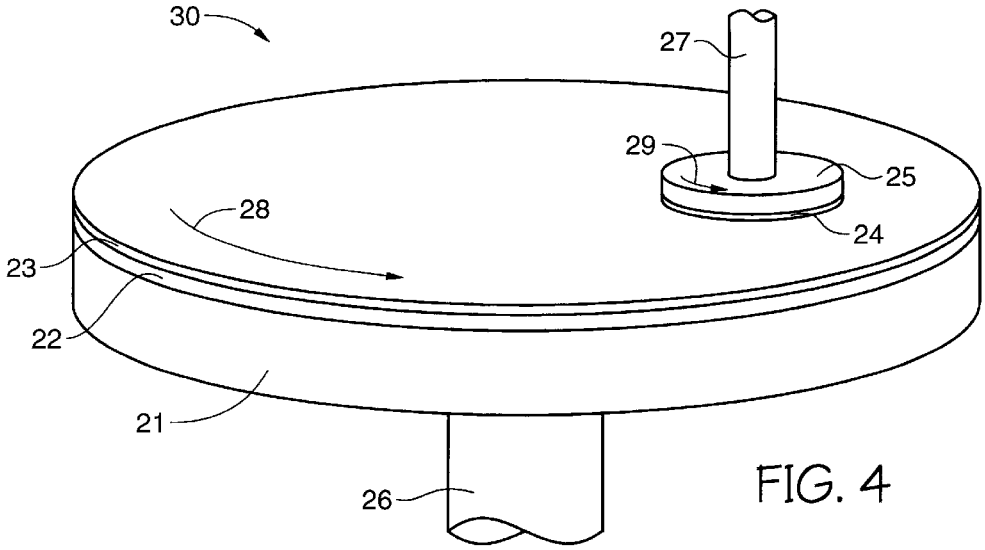
FIG. 4 is a perspective view of an exemplary portion of a CMP system in accordance with the present invention.
Figure 5:
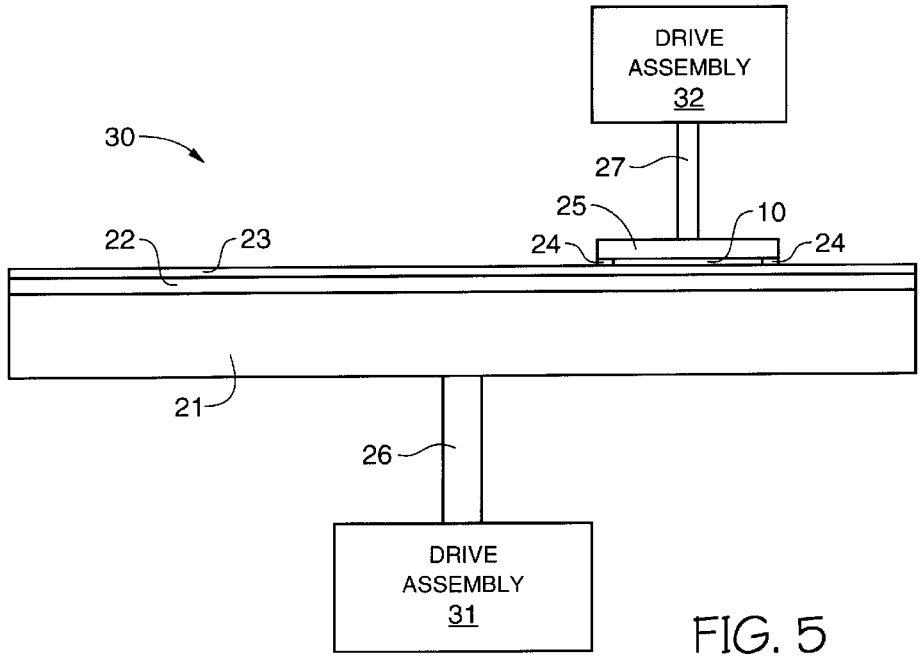
FIG. 5 is a cross-sectional view of the CMP system of FIG. 4.

Referring to FIG. 4, there is shown a perspective view of an exemplary portion of a CMP system (chemical-mechanical polisher) 30 in accordance with the present invention. In FIG. 5, there is shown a cross-sectional view of CMP system 30 of FIG. 4, where drive assemblies 31 and 32 have been added. System 30 comprises platen 21, surface-patterned-non-porous polishing pad 22, CMP solution 23, support ring 24, and substrate assembly carrier ("wafer carrier") 25. Platen 21 and wafer carrier 25 are attached to drive shafts 26 and 27, respectively, for rotation. Conventionally, platen 21 and wafer carrier 25 are rotated in a same direction, as illustratively indicated in FIG. 3 by arrows 28 and 29. Other conventional details with respect to CMP system 30 have been omitted to more clearly describe the present invention.

Notably, wafer carrier 25 may be rotated at one or more speeds, and such rotational speed may be varied during processing to affect material removal rate. It should be understood that it is not necessary to use rotational movement, rather any movement across contact portions and non-contact portions of pad 22 may be used, including but not limited to linear movement.

Figure 6:
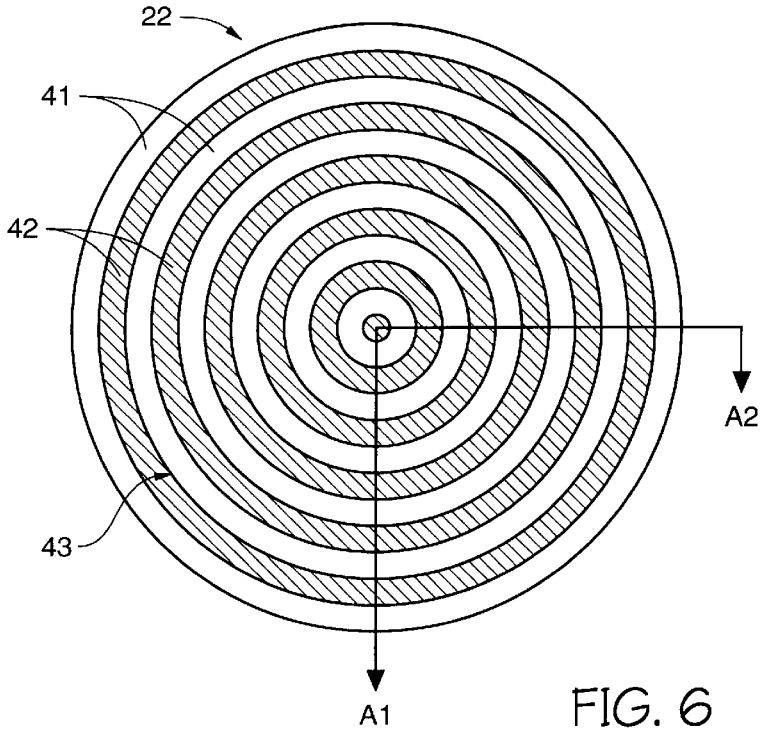
FIG. 6 is a top elevation view of an embodiment of a circular-polishing pad in accordance with the present invention.

In FIG. 6, there is shown a top elevation view of an embodiment of polishing pad 22 in accordance with the present invention. Pad 22 comprises a non-porous surface 43 having contact portions (e.g., islands) 41 and non-contact portions (e.g., recesses) 42. While pad 22 may be made of a solid non-porous material, it may also be formed of more than one material, where a contact surface is formed of the non-porous material.

While pad 22 has been shown with radially extending concentric islands and recesses, such configuration is just one embodiment. For example, elliptical, spiral, or transverse (linear) recesses and islands may be employed in accordance with the present invention. Alternatively, discrete islands may be formed on a CMP pad. By way of example and not limitation, such discrete islands may be pillars, pyramids, mesas (including frusticonicals), cones, and like protrusions extending upward from a CMP pad surface. Such discrete islands may be spaced apart to provide at least one predetermined gap between them to provide at least one duty cycle. Such islands may be arranged to form rings, stripes, spirals, or ellipses, among other patterns.

Figure 7:
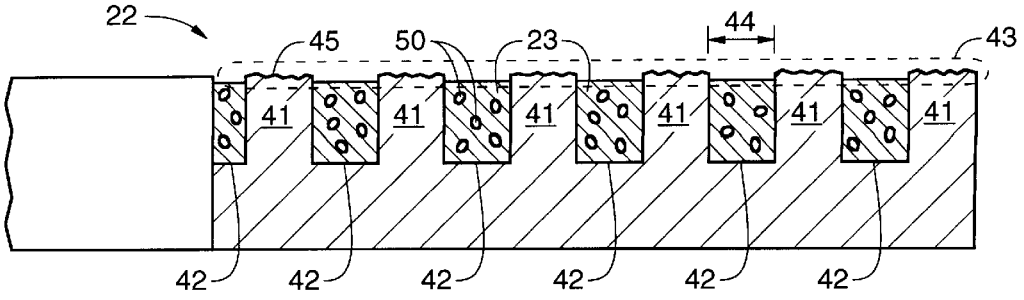
FIG. 7 is a cross-sectional view along A1–A2 of the pad of FIG. 6.

In FIG. 7, there is shown a cross-sectional view along A1–A2 of pad 22 of FIG. 6. Contact portions 41 have formed or micro-roughened top surfaces 45 to allow CMP solution particles 50 to move across them. Alternatively, microelements, such as those described in U.S. Pat. No. 5,578,362, may be impregnated in pad 22 to provide a micro-textured surface. Width (pitch) 44 is wider than CMP solution particles 50 used in CMP solution 23. While widths 44 are shown as uniform, widths of varying sizes may be used.

While not wishing to be bound by theory, what ensues is an explanation of what is believed to be the theory of operation of pad 22. Because pad 22 is formed with contact and non-contact portions, as well as a non-porous surface 43, it is possible to distinctly separate mechanical and chemical interactions of a CMP process. Therefore, such a CMP pad has both abrasion (contact to a substrate assembly surface with CMP solution particles) regions and hydrolyzation (contact to a substrate assembly surface with CMP solution) regions to remove material. Along surfaces 45, material removal is mostly or completely a mechanical interaction governed by Preston's equation. Along non-contact portions 42, material removal is mostly or completely a chemical interaction governed by the equation:

$$R_{OH}=K_{OH}f[\mathrm{pH}] \quad (2)$$

where $R_{OH}$ is the chemical removal rate, $K_{OH}$ is a hydrolyzation reaction rate constant, and $f[\mathrm{pH}]$ is a function dependent on the pH level of CMP solution 23.

The amount of material removed is dependent in part upon the velocity, v, at which substrate assembly 40 is moved across non-contact portions 42 and contact portions 41. For a non-contact portion 42 with a width $L_1$ and an adjacent contact portion 41 with a width $L_2$, the amount of material removed on a pass over $L_1$ and $L_2$ may be mathematically expressed as:

$$(R_{OH}*L_1+R_{CMP}*L_2)/v. \quad (3)$$

For balanced removal between chemical and mechanical removal, $$R_{OH}*L_1=R_{CMP}*L_2. \quad (4)$$

To illustrate this point for two different materials M1 and M2, a ratio of total material removed in a pass over $L_1$ and $L_2$ may be mathematically expressed as:

$$\frac{(R_{OH,M1}*L_1+R_{CMP,M1}*L_2)/v}{(R_{OH,M2}*L_1+R_{CMP,M2}*L_2)/v}, \quad (5)$$

where $R_{CMP,M1}$ and $R_{CMP,M2}$ are removal rates of non-hydrolyzed materials M1 and M2, respectively.

If, for example, M1 is BPSG and M2 is TEOS, then, if $L_1>>L_2$, BPSG to TEOS selectivity is governed by the relative hydrolyzation rates of M1 and M2. Such selectivity may be approximated by an associated wet etch chemistry selectivity. However, if $L_1<<L_2$, BPSG to TEOS selectivity is governed by CMP coefficients (i.e., the relative abrasion rates of M1 and M2) and approaches a non-recessed pad selectivity. Therefore, by changing the relationship between $L_1$ and $L_2$, selectivity as between materials may be adjusted, as well as enhancing the relative contribution of removal rates of an etch chemistry.

While the above embodiments have been described in terms of one and two materials, it should be understood that more than two materials may be polished in accordance with the present invention. For example, for m materials, a chemical reaction rate $R_C$ and a CMP removal rate $R_M$, Equation 3 may be expressed as:

$$\sum_{n=1}^{m}(R_{C,Mn}*L_1+R_{M,Mn}*L_2)/v. \quad (6)$$

Figure 8:
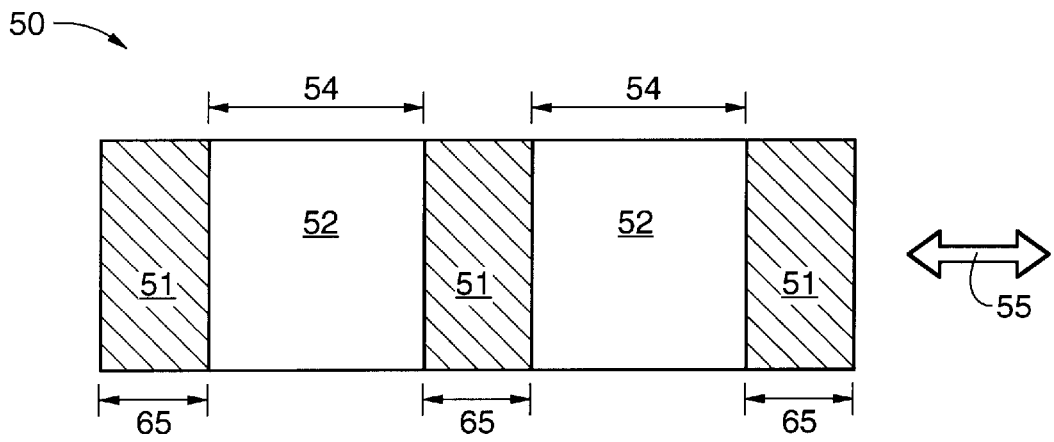
FIGS. 8 and 9 are top elevation views of exemplary portions of respective embodiments of linear polishing pads in accordance with the present invention.
Figure 9:
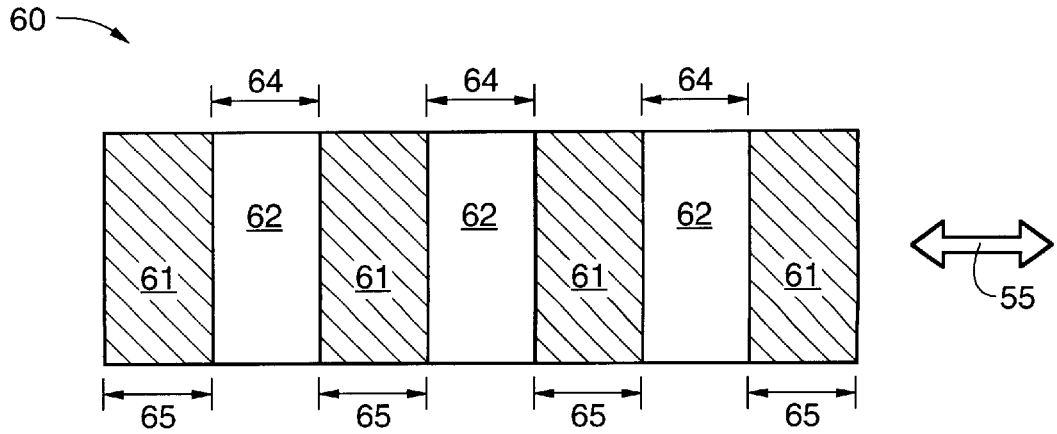

By way of example, FIGS. 8 and 9 illustratively show two non-porous pads 50 and 60 having different configurations in accordance with the present invention. Pad 50 comprises transverse contact portions 51 and non-contact portions 52, and pad 60 comprises transverse contact portions 61 and non-contact portions 62. Pitch 54 of non-contact portions 52 is greater than pitch 64 of non-contact portions 62.

Pads 50 and 60 have different recess pitches, namely, pitch 54 and pitch 64. For a constant linear velocity 55, relative polishing movement of a substrate assembly 10 (shown in FIG. 1) across portions 51, 52 and 61, 62, pitches 54 and 64 provide different contact frequencies. Consequently, contact-to-non-contact time ratio is adjustable. In other words, the ratio of contact portion 51, 61 pitch to non-contact portion 52, 62 pitch, respectively, affects contact-to-non-contact time. Thus, pad 50 has a different non-contact to contact duty cycle than pad 60. It should be understood that one or more predetermined duty cycles with respect to contact and non-contact portions may be provided with a pad in accordance with the present invention.

Figure 10:
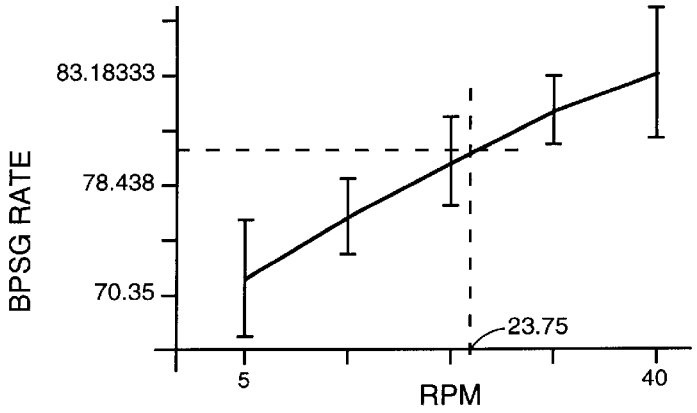
FIGS. 10 and 11 are graphs for removal rates of BPSG and TEOS, respectively, for an embodiment of a CMP process in accordance with the present invention.
Figure 11:
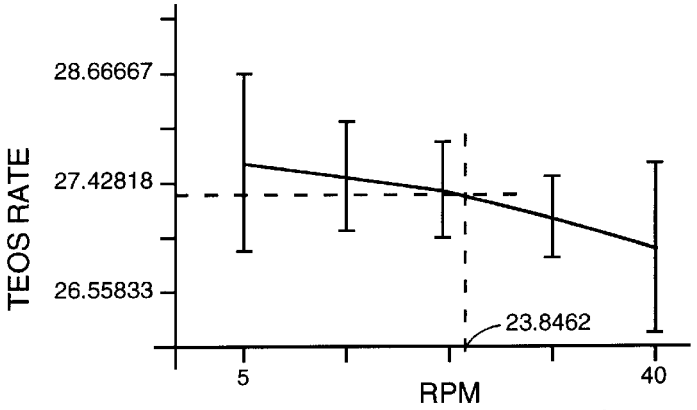

For the above-mentioned embodiment to remove BPSG and stop on TEOS, approximately a 1 mm contact pitch and approximately a 0.2 mm non-contact pitch were employed. In this embodiment, approximately a 6 to 1 selectivity ratio of selecting BPSG over TEOS was obtained, which is a 50 percent improvement over the prior art. Notably, this selectivity was achieved operating at a speed of 0.75 rev/s (45 rpm). This embodiment provides that TEOS may be removed at a rate in a range of 0.83 to 5.00 nm/s and BPSG may be removed at a rate in a range of 3.33 to 10.00 nm/s to provide a 6 to 1 selectivity ratio. FIGS. 10 and 11 are graphs for removal rates of BPSG and TEOS, respectively, for the above-mentioned CMP process embodiment in accordance with the present invention. A Rodel ILD1300 slurry and a polyurethane based pad, also available from Rodel, were used.

Contact portions of a CMP pad in accordance with the present invention are directed to mechanical abrasion for material removal, and non-contact portions of the pad act as discrete reactors for chemical reaction, such as hydrolyzation of silicon oxide or oxidation of metal. Owing to forming such a pad with a non-porous surface having a predetermined duty cycle, chemical and mechanical actions to remove materials in a CMP process are separated. Such a predetermined spatial frequency or duty cycle may be provided for enhancing selectively for removing one material over another.

Figure 12:
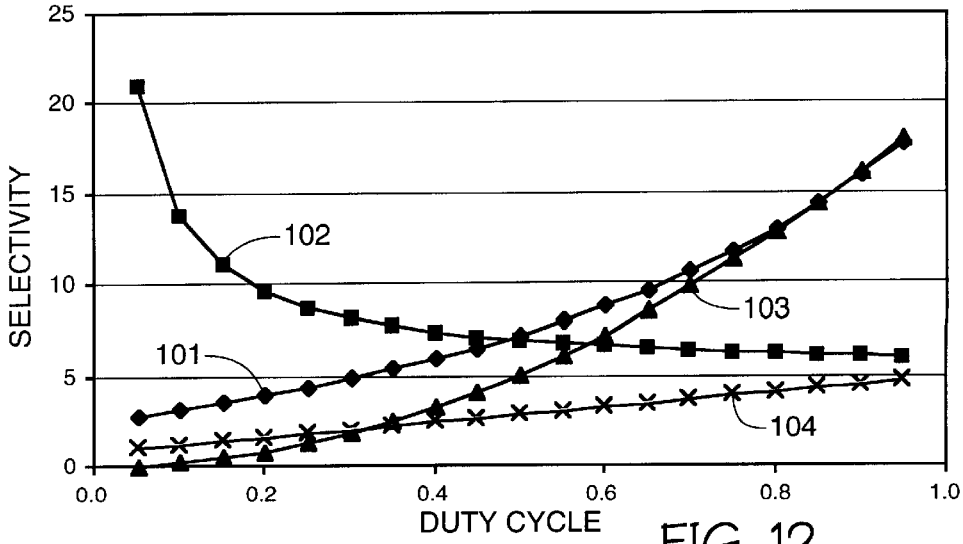
FIG. 12 is a graph of duty cycle versus selectivity in accordance with the present invention.

Referring now to FIG. 12, there is shown a graph of duty cycle versus selectivity in accordance with the present invention. Duty cycle in FIG. 12 is the ratio of $L_1/(L_1+L_2)$. To graphically indicate how the present invention may be employed to alter selectivity between different materials, selectivity is varied with a change in duty cycle for four examples. By way of example and not limitation, periodicity in FIG. 12 was set at or about 2 mm (i.e., $L_1+L_2$ was set equal to 2 mm).

Curve 101 represents an example where diffusion coefficients and abrasion coefficients (e.g. $K_{CMP}$) are relatively dominant factors in selectivity, such as when two dielectrics are present. More particularly, diffusion coefficient (D) is affected by doping. By way of example and not limitation, BPSG with a 7% P and 3% B doping was selected as M1, and PTEOS with no doping was selected as M2. The ratio of $D_{M1}/D_{M2}$ for these materials is about 20, and the ratio of $K_{CMP,M1}$ to $K_{CMP,M2}$ for these materials is about 4. From the graph of FIG. 12, selectivity increases along curve 101 as $L_1$ approaches $L_1+L_2$, according to Equation 5, where $L_1=L_2$.

Curve 102 represents an example where abrasion coefficients and chemical removal rates (e.g., $R_{OH}$) are relatively dominant factors in selectivity, such as when two dielectrics are present. By way of example and not limitation, HDP oxide was selected as M1, and $Si_3N_4$ was selected as M2. The ratio of $K_{CMP,M1}$ to $K_{CMP,M2}$ is about 6, and the ratio of $R_{OH,M1}$ to $R_{OH,M2}$ is about 100. From the graph of FIG. 12, selectivity decreases along curve 102 as $L_1$ approaches $L_1+L_2$, according to Equation 5, where $L_1=L_2$. Polishing a silicon nitride in the above example may be extrapolated to polishing a semiconductor, such as silicon, germanium, et al., or a semiconductive composition, such as a GaAs, et al., in the presence of a dielectric.

Curves 103 and 104 represent examples where chemical removal rates, abrasion coefficients, and passivation efficiency (P) are relatively dominant factors in selectivity, such as when two dielectrics or two conductors are present. By way of example and not limitation for curve 103, BPSG was selected as M1, and tungsten (W) was selected as M2. The ratio of $K_{CMP,M1}$ to $K_{CMP,M2}$ is about 20, and the ratio of $R_{OH,M1}$ to $R_{OH,M2}$ is about a 1000 or greater, as there is no meaningful hydrolyzation of metal. From the graph of FIG. 12, selectivity increases along curve 102 as $L_1$ approaches $L_1+L_2$, according to Equation 5, where $L_1=L_2$.

By way of example and not limitation for curve 104, aluminum (Al) was selected as M1, and titanium (Ti) was selected as M2. The ratio of $K_{CMP,M1}$ to $K_{CMP,M2}$ is about 10, and the ratio of $R_{OH,M1}$ to $R_{OH,M2}$ is about 0.5. Passivation efficiency for Al is about 0.6 and passivation efficiency for Ti is about zero. From the graph of FIG. 12, selectivity increases along curve 102 as $L_1$ approaches $L_1+L_2$, according to Equation 5, where $L_1=L_2$.

In accordance with the present invention, by selecting $L_1$ and $L_2$, a CMP pad may be configured to have a target selectivity with respect to removing one or more materials in the presence of one or more other materials. Such a pad may then be placed on a CMP platform (e.g., platen, web, belt, and the like) for more selectively removing one or more materials over one or more other materials from a substrate assembly.

While the present invention has been particularly shown and described with respect to certain embodiment(s) thereof, it should be readily apparent to those of ordinary skill in the art that various changes and modifications in form and detail may be made without departing from the spirit and scope of the present invention as set forth in the appended claims. Accordingly, it is intended that the present invention only be limited by the appended claims.

What is claimed is:

1. A method for forming a chemical-mechanical-polishing (CMP) pad to remove a first layer of material more rapidly than a second layer of material, said first layer of material and said second layer of material forming at least part of a substrate assembly, said method comprising:

providing a sheet member, said sheet member intrinsically non-porous with respect to CMP solution particles to be used with said CMP pad;

forming said sheet member to provide spaced-apart contact portions, said contact portions separated by at least one non-contact portion, said contact portions providing a surface to contact said substrate assembly during CMP, said contact portions spaced-apart to provide a predetermined duty cycle, said duty cycle predetermined to provide a target selectivity; and said duty cycle predetermined at least in part by:

selecting a distance between said contact portions depending at least in part on said first layer of material and said second layer of material; and selecting a width for said contact portions depending at least in part on said first layer of material and said second layer of material.

2. The method of claim 1, wherein said duty cycle is predetermined in part from a first CMP removal rate ($R_{M1}$) associated with said first layer of material, a second CMP removal rate ($R_{M2}$) associated with said second layer of material, a first chemical reaction rate ($R_{C1}$) associated with said first layer of material, and a second chemical reaction rate associated with said second layer of material ($R_{C2}$).

3. The method of claim 2, wherein said duty cycle is predetermined from a ratio:

$$(R_{C1}*L_1+R_{M1}*L_2)/(R_{C2}*L_1+R_{M2}*L_2),$$

where $L_1$ is said distance between said contact portions, and where $L_2$ is said width for said contact portions.

4. The method of claim 3, wherein said first chemical reaction rate and said second chemical reaction rate depend on a CMP solution to be used, said non-contact portion configured to contain said CMP solution for reaction with said substrate assembly.

5. The method of claim 4, wherein said first CMP removal rate and said second CMP removal rate depends in part on a coefficient of friction between said CMP pad and said substrate assembly.

6. The method of claim 1, wherein one of said first layer of material and said second layer of material is an insulator.

7. The method of claim 1, wherein one of said first layer of material and said second layer of material is a semiconductor.

8. The method of claim 1, wherein one of said first layer of material and said second layer of material is a conductor.

9. The method of claim 1, wherein said first layer of material and said second layer of material are insulators.

10. The method of claim 1, wherein said first layer of material and said second layer of material are conductors.

11. A method for forming a chemical-mechanical-polishing (CMP) pad to remove a first material more rapidly than a second material, said first material and said second material forming at least part of a substrate assembly, said CMP pad to be used with a CMP solution having particles, said method comprising:

providing a polymer sheet, said polymer sheet intrinsically non-porous with respect to said particles;

forming said polymer sheet to provide spaced-apart contact portions, said contact portions formed to allow said particles to be transported, said contact portions separated by at least one non-contact portion for containing said CMP solution for reacting with said substrate assembly during CMP, said contact portions providing a surface to contact said first material and said second material of said substrate assembly during CMP, said contact portions spaced-apart to provide a predetermined duty cycle, said duty cycle predetermined to provide a target selectivity; and said duty cycle predetermined at least in part by:

selecting a distance between said contact portions depending at least in part on said first material and said second material; and selecting a width for said contact portions depending at least in part on said first material and said second material.

12. The method of claim 11, wherein said duty cycle is predetermined in part from a first CMP removal rate ($R_{M1}$) associated with said first material, a second CMP removal rate ($R_{M2}$) associated with said second material, a first chemical reaction rate ($R_{C1}$) associated with said first material, and a second chemical reaction rate associated with said second material ($R_{C2}$).

13. The method of claim 12, wherein said duty cycle is predetermined from a ratio:

$$(R_{C1}*L_1+R_{M1}*L_2)/(R_{C2}*L_1+R_{M2}*L_2),$$

where $L_1$ is said distance between said contact portions, and where $L_2$ is said width for said contact portions.

14. The method of claim 13, wherein said first chemical reaction rate and said second chemical reaction rate depend on said CMP solution to be used.

15. The method of claim 14, wherein said first CMP removal rate depends in part on a coefficient of friction between said polymer sheet and said first material.

16. The method of claim 11, wherein one of said first material and said second material is an insulator.

17. The method of claim 11, wherein one of said first material and said second material is a semiconductor.

18. The method of claim 11, wherein one of said first material and said second material is a conductor.

19. The method of claim 11, wherein said first material and said second material are insulators.

20. The method of claim 11, wherein said first material and said second material are conductors.

* * * * *

UNITED STATES PATENT AND TRADEMARK OFFICE

CERTIFICATE OF CORRECTION

PATENT NO. : 6,203,407 B1
DATED : March 20, 2001
INVENTOR(S) : Robinson

It is certified that error appears in the above-identified patent and that said Letters Patent is hereby corrected as shown below:

Title page, Item [54],
In the Title, delete "METHOD AND APPARATUS FOR INCREASING-CHEMICAL-POLISHING SELECTIVITY" and insert -- METHOD AND APPARATUS FOR INCREASING CHEMICAL-MECHANICAL-POLISHING SELECTIVITY --, therefor.

Signed and Sealed this

Sixth Day of November, 2001

*Attest:*

Nicholas P. Godici

*Attesting Officer*

NICHOLAS P. GODICI
*Acting Director of the United States Patent and Trademark Office*